US011031698B2

(12) United States Patent
Gerl

(10) Patent No.: US 11,031,698 B2
(45) Date of Patent: Jun. 8, 2021

(54) BROAD-BAND SLOT ANTENNA COVERED ON THE REAR SIDE, AND ANTENNA GROUPS COMPRISING SAME

(71) Applicant: Kathrein SE, Rosenheim (DE)

(72) Inventor: Markus Gerl, Schonstett (DE)

(73) Assignee: KATHREIN BROADCAST GMBH

( * ) Notice: Subject to any disclaimer, the term of this patent is extended or adjusted under 35 U.S.C. 154(b) by 0 days.

(21) Appl. No.: 16/604,529

(22) PCT Filed: Apr. 2, 2018

(86) PCT No.: PCT/DE2018/100292
§ 371 (c)(1),
(2) Date: Oct. 10, 2019

(87) PCT Pub. No.: WO2018/188687
PCT Pub. Date: Oct. 18, 2018

(65) Prior Publication Data

US 2020/0059001 A1 Feb. 20, 2020

(30) Foreign Application Priority Data

Apr. 12, 2017 (DE) ..... 10 2017 107 901.7

(51) Int. Cl.
*H01Q 13/18* (2006.01)
*H01Q 13/10* (2006.01)
(Continued)

(52) U.S. Cl.
CPC ..... *H01Q 13/18* (2013.01); *H01Q 1/42* (2013.01); *H01Q 5/385* (2015.01)

(58) Field of Classification Search
CPC ..... H01Q 13/10; H01Q 13/18; H01Q 1/42; H01Q 5/378; H01Q 5/385
See application file for complete search history.

(56) References Cited

U.S. PATENT DOCUMENTS 4,132,995 A * 1/1979 Monser ..... H01Q 13/18 343/767
7,339,541 B2 3/2008 Schadler
(Continued)

FOREIGN PATENT DOCUMENTS

WO 2018188687 A1 10/2018

OTHER PUBLICATIONS

Li et al., Development of a Cavity-Backed Broadband Circularly Polarized Slot/Strip Loop Antenna With a Simple Feeding Structure, IEEE Transactions on Antennas and Propagation, vol. 56 No. 2, Feb. 2008, 7 pages.
(Continued)

*Primary Examiner* — Hoang V Nguyen
(74) *Attorney, Agent, or Firm* — Fish IP Law, LLP

(57) ABSTRACT

The invention relates to a slot antenna comprising the following elements: a peripheral housing wall, a rear wall, a feed element, and a feed point. Said slot antenna is characterized in that: the feed element is electrically connected to the housing wall at two opposing connection points; the feed element is narrower who at the connection points than in the middle region between the connection points; the feed point is located on the edge of the middle region between the connection points, as well as a corresponding opening in the housing wall; a conductor for feeding the slot antenna can be connected to the feed point; and the feed element comprises at least one slot.

9 Claims, 5 Drawing Sheets

(51) Int. Cl.
*H01Q 5/385* (2015.01)
*H01Q 1/42* (2006.01)

(56) References Cited

U.S. PATENT DOCUMENTS

2011/0241948 A1* 10/2011 Bevelacqua ..... H01Q 5/378
343/702
2013/0063321 A1 3/2013 Ruvinsky et al.

OTHER PUBLICATIONS

Yu et al., Wideband Horizontally Polarized Omni-directional Antenna, 2016 Progress in Electromagnetic Research Symposium (PIERS), Shanghai, China, Aug. 8-11, 3 pages.

* cited by examiner

BROAD-BAND SLOT ANTENNA COVERED ON THE REAR SIDE, AND ANTENNA GROUPS COMPRISING SAME

The invention concerns a broad-band slot antenna covered on the rear side, and antenna groups comprising the same.

Antenna systems according to the cavity back-end slot principle are known, which are usually accommodated in steel pipes with attached wings for graph generation and a GRP pipe for the radome with appropriate size. Modified T-Bar Fed slot antennas are known for example from the U.S. Pat. No. 4,101,900 A. Wideband slot antennas with low VSWR are known e.g. from the U.S. Pat. No. 6,150,988 A, and Wideband Cavity back-end antennas are known e.g., from the U.S. Pat. No. 7,339,541 B2.

Figure 1:
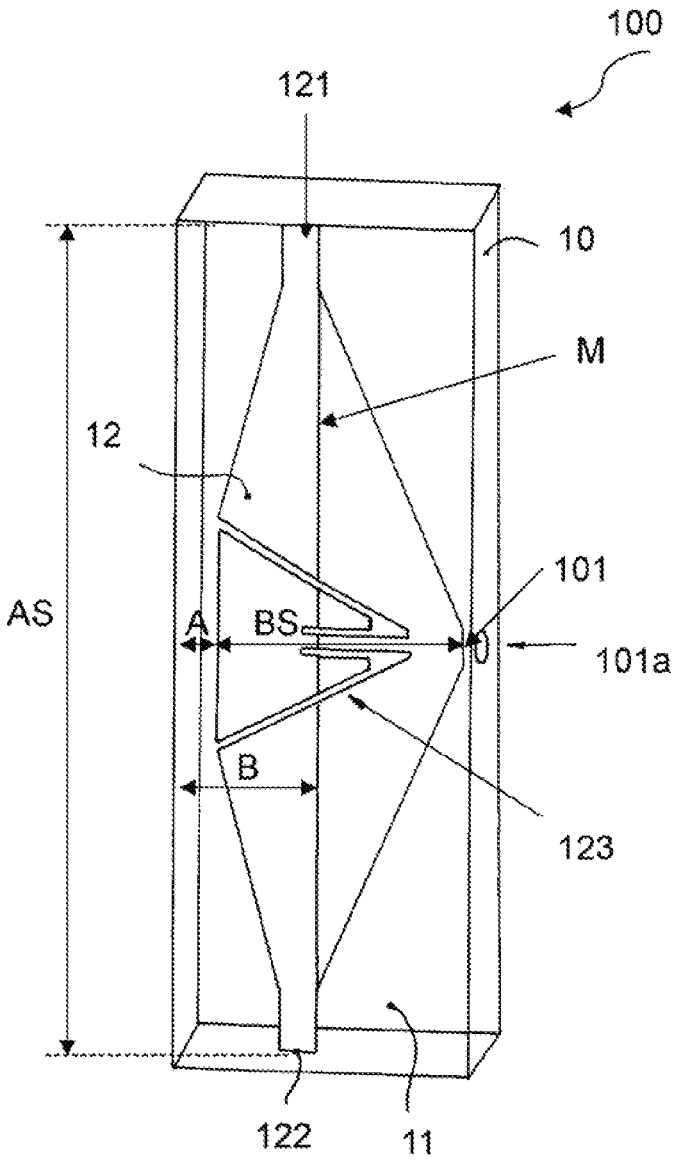

In the following, preferred embodiments of the invention are explained in greater detail based on the attached drawing. It shows:

FIG. 1 a front view of the slot antenna according to an embodiment of the present invention.

Figure 2:
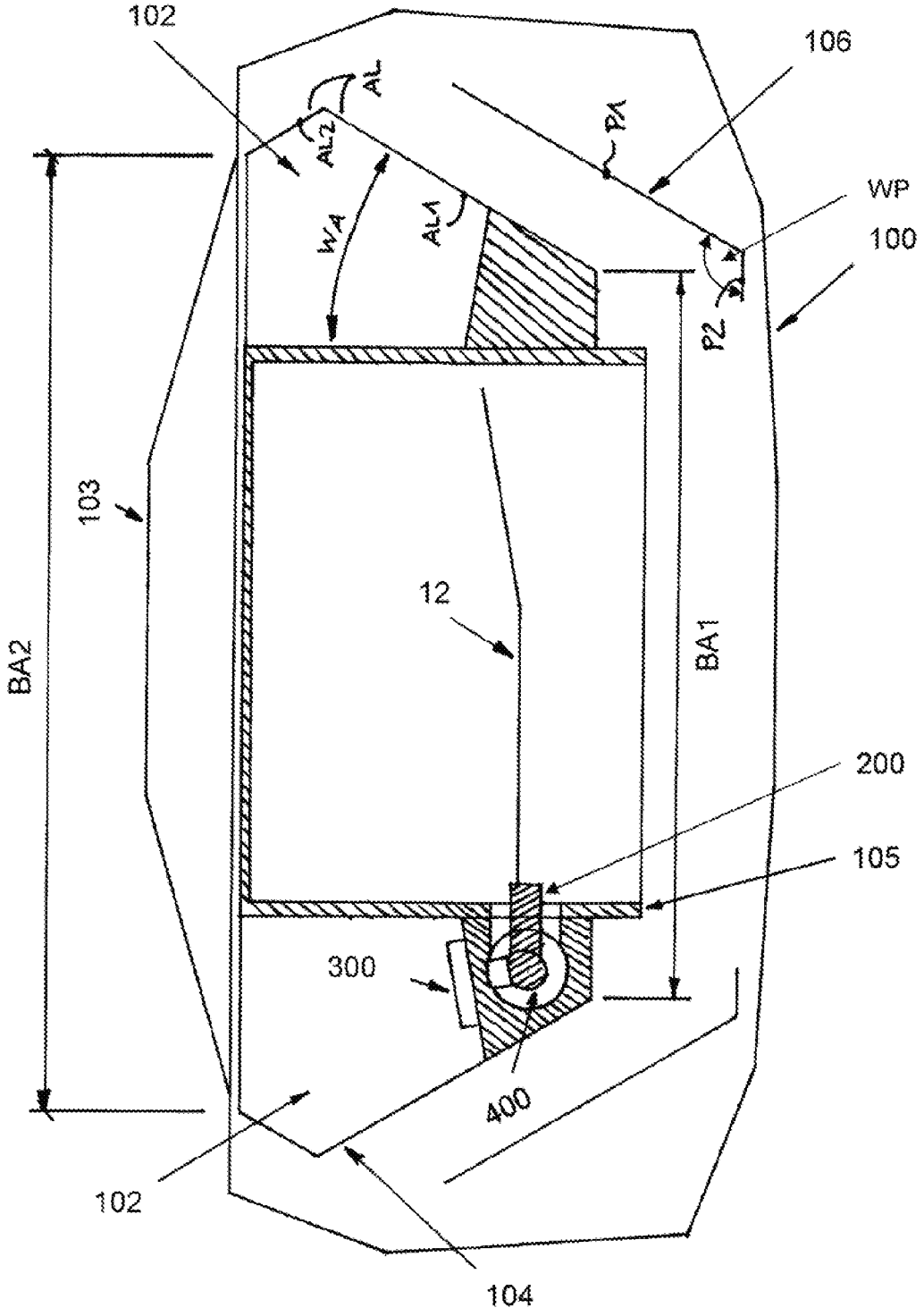

FIG. 2 a top view of a cross-section by a slot antenna according to an embodiment of the present invention.

Figure 3:
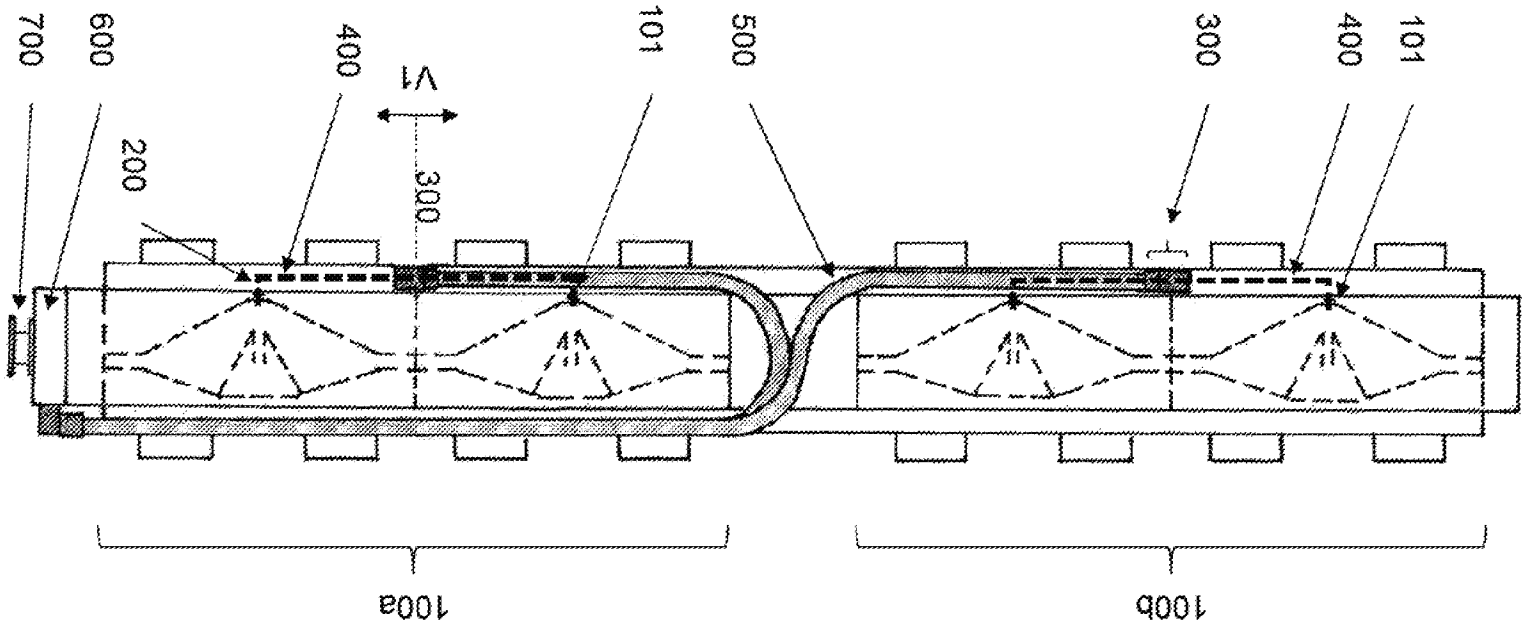

FIG. 3 a rear view of a group antenna, comprising two subgroups, each consisting of 2 slot antennas, according to an embodiment of the present invention.

Figure 4:
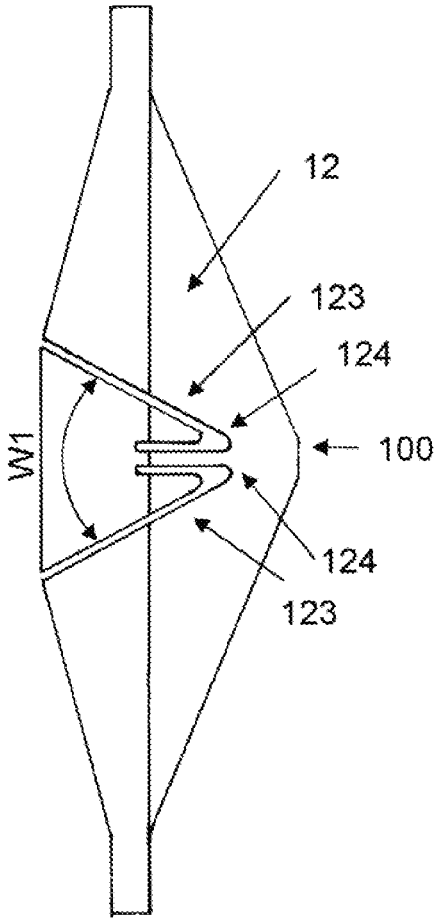

FIG. 4 a feed element with single-sided slots according to an embodiment design of the present invention.

Figure 5:
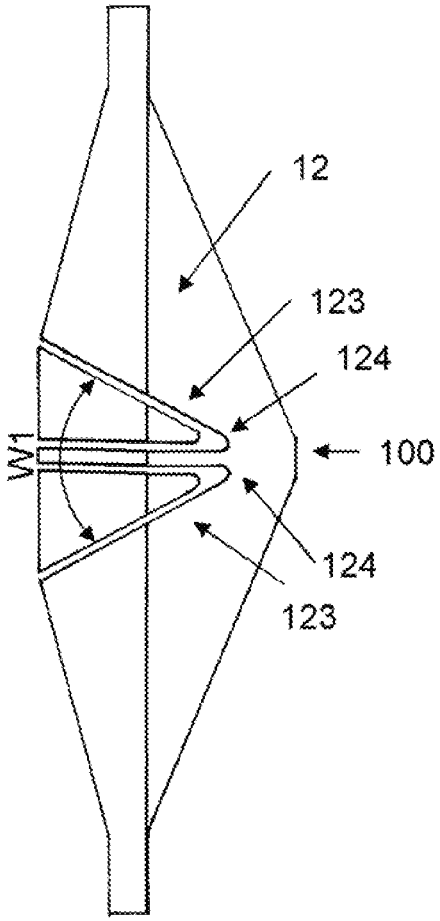

FIG. 5 a feed element with open slots on both sides according to an embodiment of the present invention.

Figure 6B:
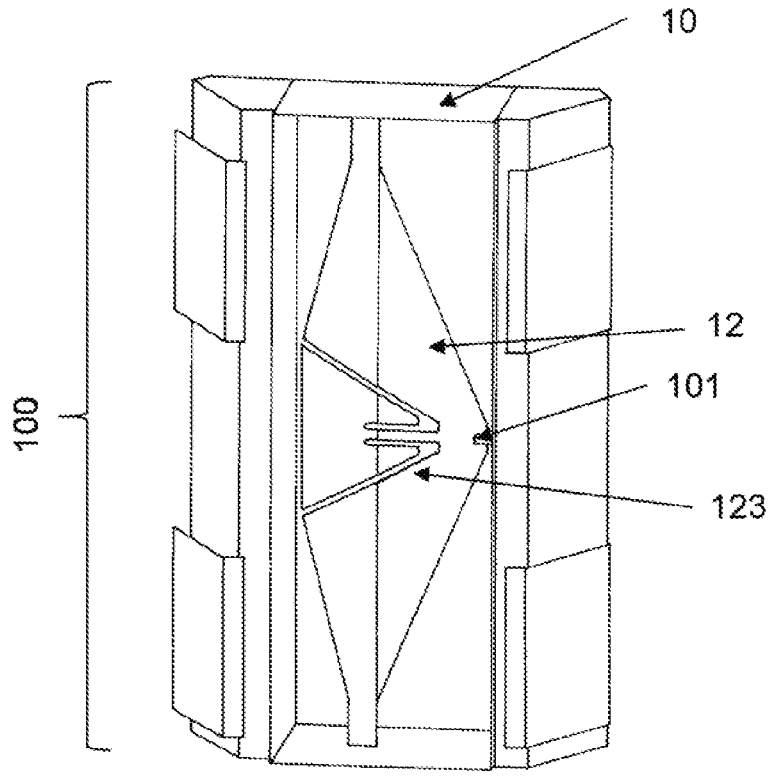
Figure 6A:
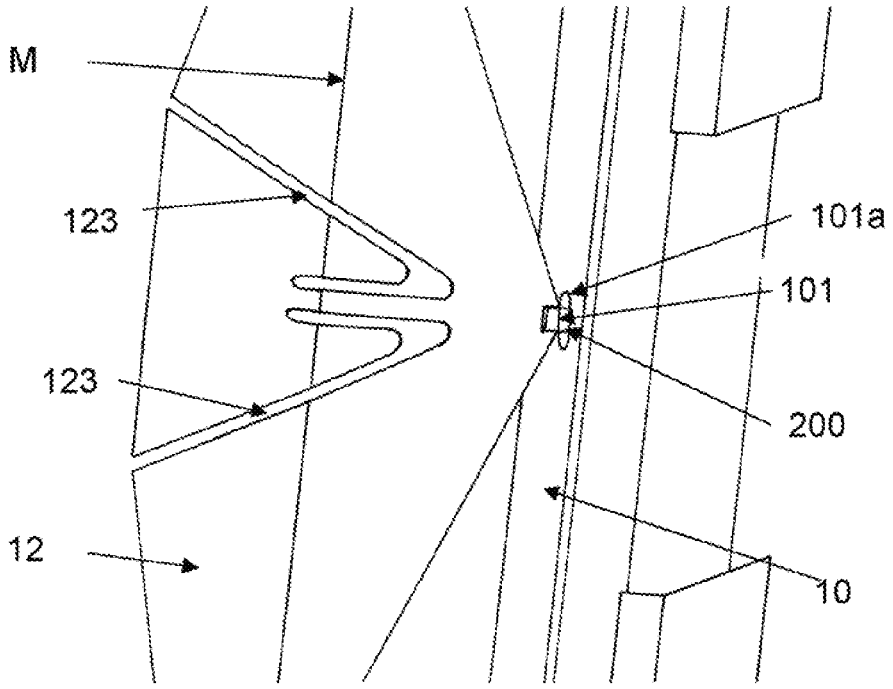

FIG. 6*a* a 3D view of a slot antenna according to an embodiment of the present invention.

FIG. 6*b* an enlarged 3D view of a detail with the feed point according to an embodiment of the present invention.

In the following description of the figures, identical elements or functions are marked with the same reference characters.

As shown in the figures, the invention is designed as follows.

The invention replaces two columns of standard 8-unit fields, which usually cover the radiated area (HPBW~160°). In contrast to the construction with 8-unit fields, the antenna system according to the invention is fully integrated with only the smallest space requirement. Components from mobile communications technology are used as radome, which are unusual in this type of construction in the radio antenna technology. For this frequency and performance range, the invention has an extraordinarily compact cross-section as well as a very flat one in respect to the ratio of width to depth.

In order to enable this flat design, the following construction elements were used in the proposed antenna system, i.e. these design criteria were specified:

- only the sides of the radiating elements of the antenna are used for supplying the transmission energy; a usually rear-mounted installation is waived,
- the necessary parasitic elements are very close to the emitter,
- a broad-band radiation of e.g. 470 to 790 MHz or other frequency ranges, depending on the application, is enabled by a special line shape with slots (T-bar fed slot),
- the required power distributor is integrated longitudinally.

Advantages

- low wind load due to compact dimensions,
- low costs by using radomes from mobile communications technology,
- simple installation by compact dimensions, as well as flat construction,
- easy and convenient shipping by means of transport options in standard cartons instead of wooden crates or the like.

FIG. 1 shows an embodiment of a proposed slot antenna 100. This comprises a circumferential housing wall 10, a rear wall 11 connected to the housing wall 10, a feed element 12 arranged within the housing formed from the housing wall 10 and the rear wall 11 with a feed point 101 for supplying the feed element 12. The feed element 12 is electrically connected via two connecting points 121, 122, opposite each other, to the housing wall 10. More precisely, the connection points are located on a section of the housing wall 10, on which the feed point 101 is not arranged. Furthermore, the feed element 12 is narrower at the connecting points 121, 122 than in the middle range between the connection points 121, 122. The feed point 101 is located at the edge, thus a section near the housing wall 10 of the central area between the connection points 121, 122, preferably In the extension of the maximum width BS of the feed element 12. At the feed point 101 in the housing wall 10, a conductor 200 can be connected for feeding the slot antenna 100 via an opening 101*a* corresponding to the feed point, as shown in FIG. 2, 3 or 6*b*. Furthermore, the feed element 12 has at least two slots 123.

Advantageously, the feed element 12 shows approximately the shape of a parallelogram or a diamond, wherein the side opposite the feed point 101 is preferably flattened. Furthermore, the distance B from the bending edge M to the housing wall 10 on the side of the flattened area of the feed element 12 is greater than the distance A between the edge of the flattened area and the housing wall 10, i.e. A<B, wherein it is advantageous if A<¼ B. The bending edge M is a line and/or edge extending approximately through the middle of the feed element 12 and substantially parallel to the flattened area. Approximately shall be understood here that the bending edge M extends with a deviation of 10-20%, but also more than 20%, of the width BS of the feed element 12, measured on a (virtual) line at the widest area between feed point 101 and the opposite housing wall or flattened area. At the bending edge M, the part of the feed element 12 can be bent with the flattened area in the direction of the rear wall 11 of the housing, preferably at an angle of up to 30°. However, it may not be bent at all, then the bending angle would be 0°.

Furthermore, the conductor 200 connected to the feed point 101 is connected to the inner conductor of a plug-in connection 300 via an internal housing conductor 400, as shown in FIG. 2 or 3.

Furthermore, the external conductor of the plug-in connection 300 is connected to the surrounding housing wall 10. The housing wall 10 is preferably made from an electrically conductive or conducting material.

Furthermore, the feed element 12 is made from an electrically conductive or conducting material such as sheet metal or from an electrically conductive layer. The inner conductor 200 can be connected to the internal housing conductor 400 via an insulating disc.

Furthermore, the length AS of the feed element 12 is greater than 0.05 or 0.1 or 0.2 or 0.3 or 0.4 or 0.5 or 0.6 or 0.7 or 0.8 or 0.9 or 1.0 or 1.2 or 1.5 or 2 wavelengths. Furthermore, the length AS of the feed element 12 is less than 0.05 or 0.1 or 0.2 or 0.3 or 0.4 or 0.5 or 0.6 or 0.7 or 0.8 or 0.9 or 1.0 or 1.2 or 1.5 or 2 wavelengths. The length AS is advantageous greater than 0.3 and less than 2 wavelengths, further advantageous greater than 0.5 and less than 1.5 wavelengths. It is particularly advantageous for the length AS to be approximately equivalent to one wavelength. The wavelength refers to the medium frequency fm of the frequency range covered by the antenna.

Through the suitable selection of the size ratios of the components of the slot antenna 100 described above, a relative bandwidth Br of 50% can be achieved with a VSWR standing wave ratio of e.g. better than 1.1. Relative bandwidth $B_r$ is calculated as follows:

$$B_r = \frac{f_o - f_u}{f_m}$$

wherein $$f_m = \frac{f_o + f_u}{2}$$

fo describes the upper operating frequency, fu the lower operating frequency, and fm represents the medium frequency.

Furthermore, the (maximum) width BS of the feed element 12 is greater than 0.01 or 0.02 or 0.05 or 0.1 or 0.2 or 0.3 or 0.4 or 0.5 or 0.6 or 0.7 or 0.8 or 0.9 or 1.0 wavelengths. Furthermore, the maximum width BS of the feed element 12 is smaller than 0.01 or 0.02 or 0.05 or 0.1 or 0.2 or 0.3 or 0.4 or 0.5 or 0.6 or 0.7 or 0.8 or 0.9 or 1.0 wavelengths. The width BS is advantageously greater than 0.01 and smaller than 1 wavelength; further advantageous the width BS is greater than 0.1 and smaller than 0.5 wavelengths. The width BS=0.3×length AS is preferred.

In FIG. 4 and FIG. 5, different embodiments of the slots 123 are shown, e.g., each slot 123 is open on one side, as shown in FIG. 4. Additionally, each slot 123 is open on both sides, as shown in FIG. 5. Alternatively, each slot 123 can be closed on both sides. The opening or openings are advantageously shown in the direction of the outside of the feed element 12, i.e. the nearest housing wall 10, as shown in the figures. The slots 123 of the feed element 12 and their adjacent areas 124 can have radii or curvatures.

Furthermore, the slots 123 in the areas, which lie closer to the connection points 121, 122, form an angle W1, as shown in FIG. 4 and FIG. 5. The angle W1 is preferably measured between the inner edges of the outer sections of the slots 123, but can also be measured between the outer edges of the outer sections of the slots 123, since the slot 123 or the slot width is very low, so that no significant deviations result here.

In addition, the angle W1 is smaller than 80°, 70°, 60°, 50°, 40°, 30°, in particular smaller than 65°. In addition, the angle W1 is smaller than 80°, 70°, 60°, 50°, 40°, 30°, in particular smaller than 45°. The angle W1 is preferably between 45° and 65°.

In addition, the slots 123 extend in the areas, which are each further distanced from the connecting points 121, 122, essentially parallel to one another, as shown in FIGS. 1, 4 and 5.

FIG. 2 shows a cross section through a slot antenna 100 or a radome, wherein at least at one outer side, preferably at both outer sides, a covering longitudinal plate 104 is located, which, together with parts of the circumferential housing wall 10, each defining in different areas respectively a free space for the wiring 102. Here, the longer width BA2 of the covering longitudinal plate 104 is greater than the shorter width BA1 of the covering longitudinal plate 104.

The covering longitudinal plate 104 comprises two sections AL1 and AL2, which form a section of the covering longitudinal plate AL. The two sections are preferably formed from one piece, but have an angle in reference to one another. The section AL1 of the covering longitudinal plate 104 forms an angle WA with the surrounding housing wall 10, which ranges from 10° to 80°, preferably from 20° to 45°.

Preferably, the covering longitudinal plate 104 comprises a second section or section AL2, angled in reference to the first section AL1. The second section AL2 can also have a curvature instead of an angle, which implies a kink. The covering longitudinal (sheet metal) plate 104 is made from an electrically conductive material as already indicated by the term sheet.

Preferably, the slot antenna contains at least two parasites, mirror-symmetrical to the middle of the antenna, wherein each parasitic shows a parasitic element 106, which extends in a section P1 essentially parallel to section AL1 of the covering longitudinal plate 104, or deviates slightly from being parallel, showing at an angle thereto, which is preferably smaller than ±10°, ±20°, ±30°.

Preferably, the parasitic element 106 comprises a section P2 angled in the direction of the rear wall 11 or bent, preferably extending parallel to the rear wall 11, which is formed such that the section P1 is angular in reference thereto, meaning that sections P1 and P2 form an angle WP to each other. This angle WP ranges preferably from 100° to 150°.

FIG. 3 shows a rear view of a group antenna, comprising two subgroups 100*a*, 100*b*, each consisting of at least two slot antennas 100 as described above and aligned serially along each other, with here serially meaning that the subgroups 100*a*, 100*b* each are connected with each other at the areas on which the connection points 121, 122 are located. In the profile of the housing wall 10, an internal housing conductor 400, which can consist of a different electrically conductive material than the housing, e.g. aluminum or silver-plated brass or copper or silver-plated or tin-plated copper, connects via an internal conductor 200 each the feed points 101 of two slot antennas 100 arranged serially using a plug-in connection 300 with a feed cable 500.

In each of the subgroups 100*a*, 100*b*, the inner conductor of a plug-in connection 300 is connected in the middle between the feed points 101 of the slot antennas 100 or at a predetermined offset V1 from the middle between the feed points 101 of the slot antenna 100 to the internal housing conductor 400 in the profile via a feed cable 500, in order to create a phase difference between the feed points 101 of the slot antenna 100 and a corresponding beam deflection, with the offset V1 being less than 5%, 10%, or 20% of the length of the feed cable 500.

The two feed cables 500 embodied as coaxial cables each extend through the free spaces for the wiring 102 of the slot antennas 100 and end in a distribution 600, from which the group antenna is fed via a coaxial input 700. The plug-in connection 300 between the inner conductor 400 and the cable 500 can also be designed as a fixed connection.

For illustration of the construction of a slot antenna 100 according to the invention, FIG. 6*a* shows a 3D view of a slot antenna 100 according to an embodiment of the present invention, and FIG. 6*b* shows an enlarged 3D view of a detail with the feed element 12 of the slot antenna 100. Same reference characters as in the previous figures describe the identical elements. The description for this is discernible respectively from the previous descriptions. Alternatively, the feed element 12, or parts thereof, as well as connecting lines such as the inner housing conductor 400 and the inner conductor of the plug-in connection 300 and the inner conductor 200 may be embodied as a conductive layer on a carrier like a circuit board.

The invention claimed is:

1. A slot antenna comprising a circumferential housing wall, a rear wall, a feed element, and a feed point, wherein:

the feed element is electrically connected at two opposite connecting points to the housing wall, the feed element is narrower at the connecting points than in the middle area between the connection points, at an edge of the middle section between the connecting points, the feed point as well as a corresponding opening in the housing wall are located, at the feed point, a conductor is connectable to supply the slot antenna, the feed element has at least two slots, at least on one outer side, preferably on both outer sides, a covering longitudinal plate is provided, which defines together with parts of the surrounding housing wall a clear space for wiring, and the width of the short side of the covering longitudinal plate is greater than the width of the long side of the covering longitudinal plate, a first section of the covering longitudinal plate forms a housing angle with the surrounding housing wall, which ranges from 10° to 80°, or from 20° to 45°, and/or the covering longitudinal plate comprises a second angled or curved area, and/or the slot antenna contains at least two mirror-symmetrical parasites, wherein each parasite comprises a parasitic element, and each parasitic element extends in a first region substantially parallel to the first section of the surrounding housing wall and/or each parasitic element comprises a second section at an angle in reference to the first section.

2. The slot antenna according to claim 1, wherein the conductor connected to the feed point is connected via an inner conductor to an inner conductor of a plug-in connection.

3. The slot antenna according to claim 2, wherein an external conductor of the plug-in connection is connected to the surrounding housing wall.

4. The slot antenna according to claim 1, wherein the feed element is made from sheet metal or from a conductive layer.

5. The slot antenna according to claim 1, wherein the length of the feed element is greater than 0.3 and less than 2 wavelengths, or greater than 0.5 and smaller than 1.5 wavelengths, or equivalent to 1 wavelength.

6. The slot antenna according to claim 1, wherein the width of the feed element is greater than 0.01 and smaller than 1 wavelength, or greater than 0.1 and smaller than 0.5 wavelengths.

7. The slot antenna according to claim 1, wherein each slot is open unilaterally or each slot is open on both sides, or each slot is closed on both sides.

8. The slot antenna according to claim 1, wherein the slots in the areas, which are each closer to the connecting points, form an angle, where the angle is smaller than 80° and greater than 30°, or ranges from 45° inclusive to 65° inclusive, and/or wherein the slots in the areas, which are each more distant from the connecting points, are essentially extending parallel.

9. A subgroup consisting of at least two slot antenna antennas according to claim 1, aligned serially and having in the profile of the housing wall an inner housing conductor connecting via an inner conductor each the feed points of the slot antennas via a plug-in connection to a feed cable, and wherein the inner conductor of a plug-in connection is connected between the feed points of the slot antenna or the with an offset from the middle between the feed points of the slot antennas to the inner housing conductor via a feed cable, with the offset being less than 5%, 10%, or 20% in reference to the length of the feed cable.

* * * * *